United States Patent [19]

Cardia

[11] Patent Number: 4,813,801

[45] Date of Patent: Mar. 21, 1989

[54] CASE FOR COSMETIC PRODUCTS, PARTICULARLY LIPSTICKS, AND METHOD FOR FILLING THE SAME

[76] Inventor: Ennio Cardia, 18 Via Durazzo, I-00195 Roma (RM), Italy

[21] Appl. No.: 40,391

[22] Filed: Apr. 20, 1987

[30] Foreign Application Priority Data

Apr. 24, 1986 [IT] Italy ..... 47927 A/86

[51] Int. Cl.[4] ..... A45D 40/04; B29C 5/00; B29F 5/00

[52] U.S. Cl. ..... 401/71; 401/78; 401/80; 206/385; 425/DIG. 32

[58] Field of Search ..... 401/71, 78, 269, 213, 401/50, 80, 87; 215/341; 206/385; 425/DIG. 32; 132/79 C, 88.5, 88.7

[56] References Cited

U.S. PATENT DOCUMENTS

| | | | |
|---|---|---|---|
| Re. 31,021 | 8/1982 | Idec et al. | 132/88.7 X |
| 1,861,552 | 6/1932 | Savery | 215/341 X |
| 2,127,350 | 8/1938 | Davis et al. | 401/71 |
| 2,797,803 | 7/1957 | Hopgood | 401/78 X |
| 2,855,632 | 10/1958 | Croce et al. | 425/DIG. 32 X |
| 3,315,344 | 4/1967 | Niclas | 401/78 X |
| 3,317,036 | 5/1967 | Cherba | 132/88.7 X |
| 3,393,036 | 7/1968 | Fuglsang-Madsen | 206/385 X |
| 3,397,027 | 8/1968 | Harrison | 401/50 |
| 3,511,575 | 5/1970 | Berins | 401/78 |
| 3,817,636 | 6/1974 | Ritzenhoff | 401/78 |
| 4,147,750 | 4/1979 | Geria et al. | 425/DIG. 32 X |
| 4,208,144 | 6/1980 | Idec et al. | 401/192 |
| 4,417,827 | 11/1983 | Kasai et al. | 401/78 X |
| 4,579,134 | 4/1986 | Moore | 401/192 X |

FOREIGN PATENT DOCUMENTS 2026983 2/1980 United Kingdom .

*Primary Examiner*—Richard J. Apley
*Assistant Examiner*—David J. Bender
*Attorney, Agent, or Firm*—Browdy and Neimark

[57] ABSTRACT

A case for stick cosmetics, particularly lipsticks is described, formed by an external base, an intermediate body, a stick holder and a cap, comprising improvements in the elements for coupling the parts together and the moulding of the parts. Methods are also described for moulding the lipstick itself directly inside the case.

12 Claims, 5 Drawing Sheets

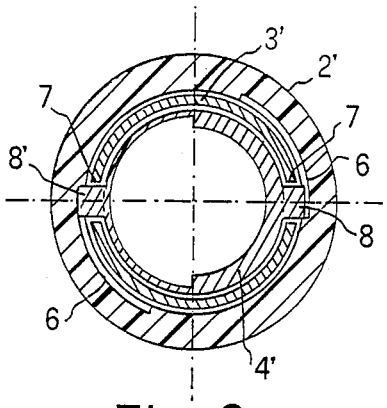
Fig. 9
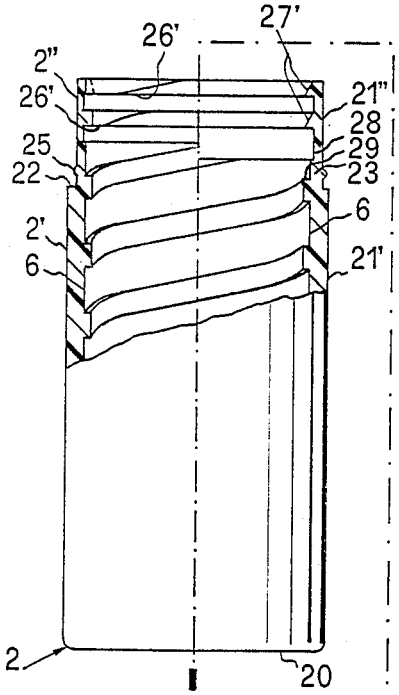
Fig. 3
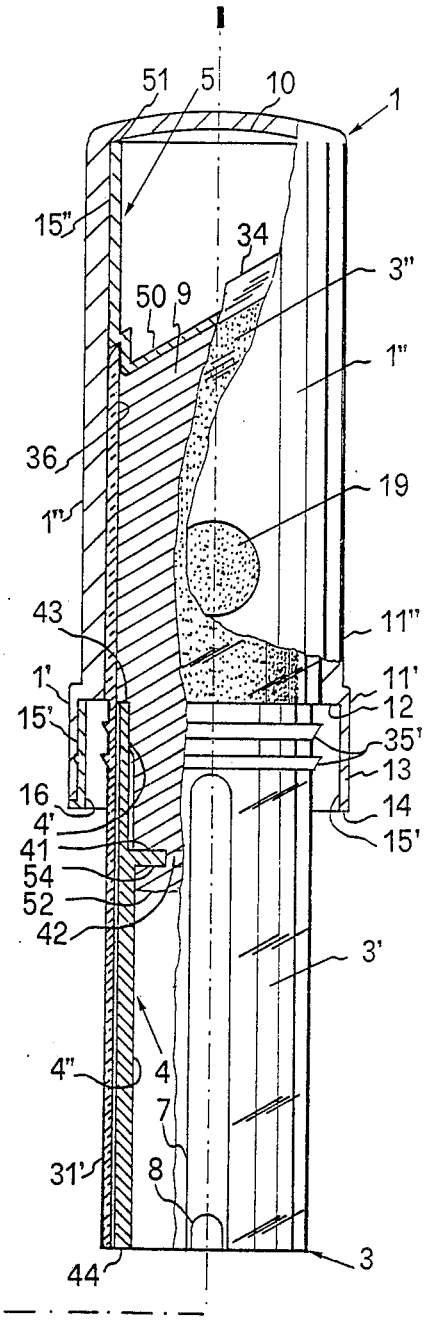

CASE FOR COSMETIC PRODUCTS, PARTICULARLY LIPSTICKS, AND METHOD FOR FILLING THE SAME

BACKGROUND OF THE INVENTION

1. Field of the Invention

The present invention refers to improvements in cases for stick cosmetics, with particular reference to lipsticks.

2. Description of the Prior Art

Cases for stick cosmetics are known in which the stick is moved from a retracted position inside the case, to a position protruding out of the extremity of the case.

SUMMARY OF THE INVENTION

Object of the present invention is to carry out improvements to these kinds of case to render them more functional, obviating the various problems associated to these mechanisms in their original form, and to ensure greater functionality, reduce the cost of production and insertion of the cosmetic in stick form, increase the aesthetic qualities and obtain a larger number of combinations for alternative models.

The improvements to cases of the type indicated briefly add the following advantages:

(1) easy anchorage of the intermediate body to the external base body;

(2) pouring of the melted product into the stick holder, for the moulding of the stick inside the case, with an upper extremity moulded to any profile whatever;

(3) control of the quality and size of the stick poured and/or inserted, directly inside the case, without any additional operations.

It is an object of the present invention, in a case for stick cosmetics of the type having:

(a) a cap in the form of a tubular sleeve with an open lower extremity;

(b) an external base in the form of a tubular sleeve with an open upper extremity, a closed bottom and an internal helicoidal groove;

(c) an intermediate body in the form of a tubular sleeve with both extremities open and a lower portion having a pair of opposed longitudinal slots and an upper portion having an increased wall thickness so as to form an outer annular periferal step, said lower portion of the intermediate body being telescopically engaged with said external base; and (d) a stick holder in the form of a tubular sleeve with open extremities and an inner partition for supporting the stick and a pair of opposed outwardly projecting pins at the lower extremity, said pins being engaged with both said grooves and said slots for a translatory movement of said stick holder along said intermediate body from a retracted to an extended position upon rotation of said external base with respect to said intermediate body, said external base and said cap having the same outer diameter;

the improvement which comprises said external base formed of one piece and having an upper portion of reduced wall thickness with an outer annular step for abutment with said cap, said upper portion of the base having at least one inner annular depression, and said intermediate body having on its outer wall at least one anular projection for a snap engagement with said depression of the base.

BRIEF DESCRIPTION OF THE DRAWINGS

The invention will be better understood from the following description of the preferred embodiments as illustrated in the accompanying drawings, in which:

FIG. 3 shows, part in cross-section and part in view, a case with a transparent intermediate body and a stick having an inclined top, with a closing capsule, for the casting of the melted product from the bottom, and sealing means between cap and external base body and alternative anchorage means;

FIG. 9 illustrates, in a cross-section top view, the relationship between an elastic pin and a rigid pin with respect to the guide slot on the intermediate body and to the guide groove on the external base body;

DESCRIPTION OF THE PREFERRED EMBODIMENTS

Figure 6:
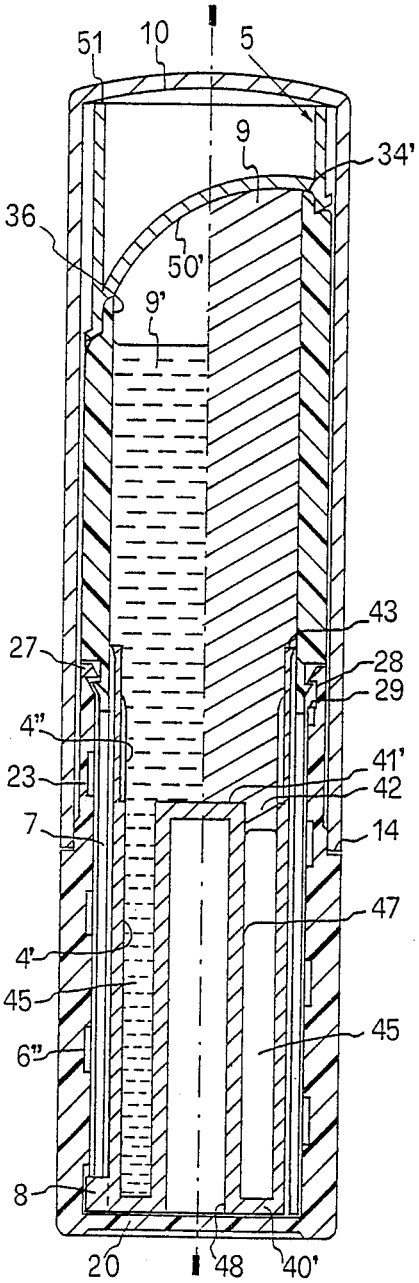
FIG. 6 shows two half cross-sections of a case with an inclined top during the casting phase and during the phase of formation of the stick respectively, in a stick holder with the lower extremity closed.
Figure 7:
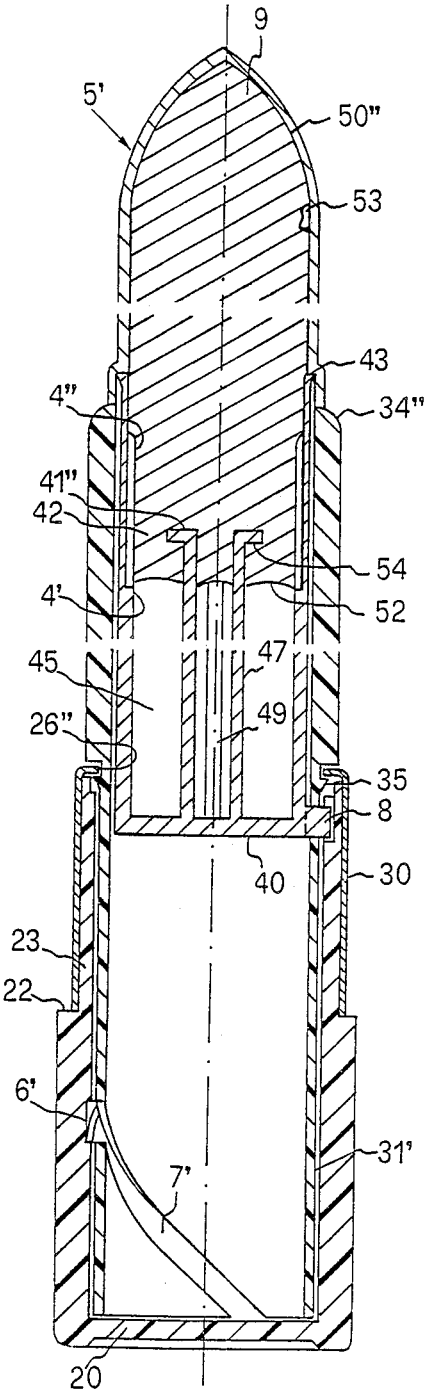
FIG. 7 is a cross-section of a case with a usual stick preformed inside a moulding capsule anchored to the stick holder with the lower extremity closed, drawn all the way out.

With reference to the above mentioned drawings, a case for stick cosmetics, to which the present invention refers, comprises four parts, nearly a cap 1, an external body 2, an intermediate body 3 and a stick holder 4. The external base body 2 has an outer surface in the form of a tubular sleeve of whatever transversal section, with a cylindrical inner wall crossed by a helicoidal guide groove. In FIG. 7 said guide groove is of less than one turn (6'), in FIGS. 1 and 6 it is of more than one turn (6''), and in the remaining FIGS. (2, 3, 4 and 5) there are two guide grooves. Said guide grooves control the movement of the pin 8 of the stick holder 4. Said external base body has an open upper extremity and a lower extremity completely closed by a bottom wall 20. It is made in a single piece and comprises the following features.

Underneath the cap 1, a lower portion 2' is positioned, with outer wall 21' of transversal section substantially equal to the transversal section of the outer wall 11 of said cap (FIGS. 1, 2, 5, 6). Should said cap be provided with two different transversal sections 11' and 11'' (FIG. 3), said outer wall 21' has a transversal section equal to at least one of the two external transversal sections.

Figure 2:
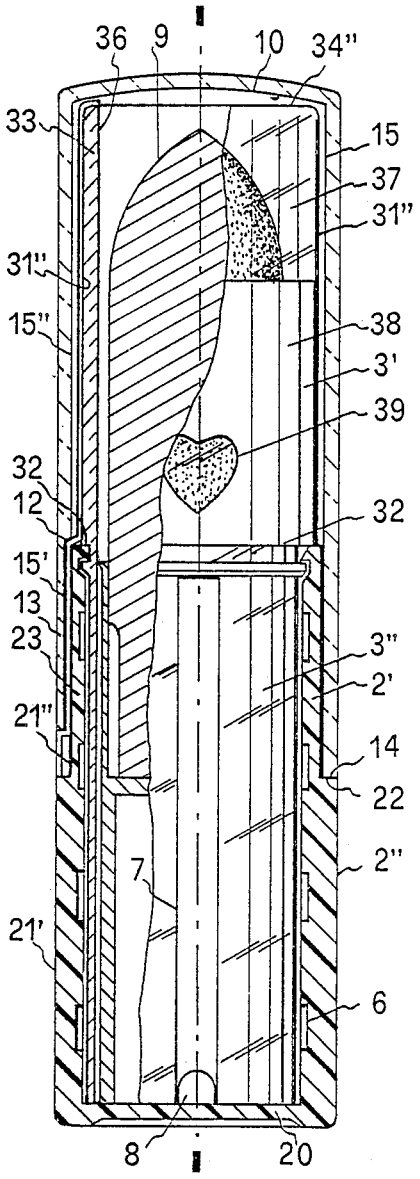
FIG. 2 illustrates a case with a transparent intermediate body, partly masked.
Figure 4:
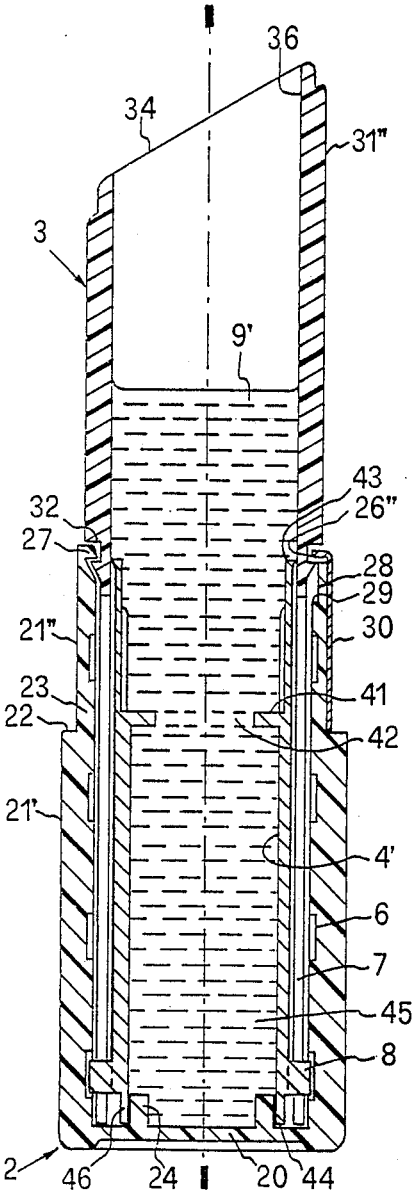
FIGS. 4 and 5 are cross-sections of a case having an inclined top during the casting phase and during the phase of formation of the stick in a holder respectively, and alternative anchorage means.
Figure 5:
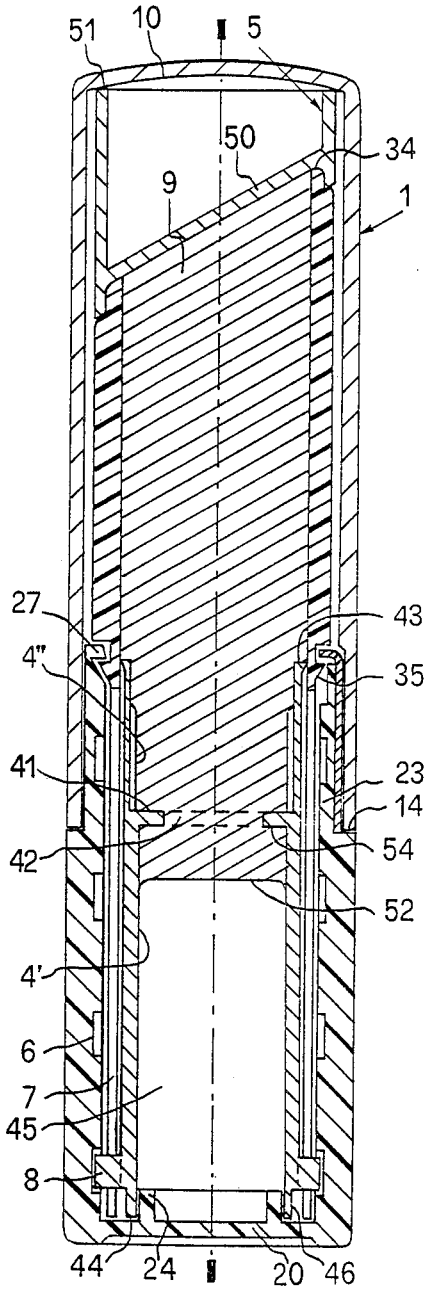

Internal to cap 1, an upper portion 2'' is positioned, eventually covered by an additional decorative element 30, such as a metallic band, (FIGS. 4, 5 right hand portions, and 7). Said upper portion 2'' has an outer wall 21'' of transversal section substantially equal to the transversal section of the inner wall 15 of cap 1 (FIGS. 2 and 5, left hand portions, 1 and 6). Should said cap be provided with two different transversal sections 15' and 15'' (FIGS. 2 and 5, right hand portions, and (3), said outer wall 21'' has a transversal sections.

The two portions 2' and 2'' are separated by an external perimetral abutment 22 onto which the free extremity 14 of the cap 1 abuts when in a closed position.

Means are also provided suitable to create a hermetically sealed closure between the inner surface 15' of the lower portion of cap 1' and the outer surface 21'' of the upper portion of the external base body 2''. Said means comprise at least one circumferential projection 25, preferably placed on one of the two connecting surfaces, which presses elasticly respectively on the other, thus determining a circumferential elastic friction. At least one of the two walls 21'' or 15' is rendered elastic by reduction of the thickness on the basis of the plastic materials used, or by integral coupling of an additional annular element 16, of material sufficiently elastic with respect to the materials employed for the two components of walls 21'' and 15', capable of determining a better circumferential elastic friction.

As can be seen from the example of FIG. 3, the circumferential projection 25 is placed on the outer wall 21'' of the upper portion of the external base body 2'', while the reduced thickness 13 is carried out by means of an internal perimetral ring 12 which divides the upper 15'' and lower 15' inner walls on the lower portion of cap 1'. Furthermore, in the left hand portion, on the inner wall 15' of the lower poriton of said cap 1', the annular elastic elemnt 16 has been added.

The improvements of the present invention also refer to the intermediate body 3, for protection and guidance of the stick 9, having the form of a tubuluar sleeve with both extremities open, made in a single piece and comprising two portions 3' and 3''.

The upper portion 3'' is considerably protruding with respect to the upper extremity of the external body 2 and is preferably of a length substantially equal to that of the stick protruding from the edge of the holder. The thickness 33 of both the inner wall 36 and the outer wall 31'' protecting stick 9, is substantially constant without grooves and/or slots. In this way, when said intermediate body 3, instead of being made of opaque material, is made of transparent material, said upper protective portion 3'' permits maximum visibility at all points of stick 9. In particular both the colour and any eventual defects of formation 53 of the stick can thus be perfectly seen (FIG. 1), directly inside the case in a protected position. Furthermore, as there is no optical deformation due to variations in thickness 33 eitheron the inner wall 36 or on the outer wall 31'', it is possible to have partial visibility of the stick 9 at whatever point through transparent areas (FIG. 2). Said transparent areas take the form of holes 39 of whatever geometric or ornamental form, or annular ringed portions 37 of whatever form and in whatever position, obtainedby use of transparent material partially masked by a covering 38, such as a metal band, a rolled tape, a galvanic layer, a serigraphy or the like.

Figure 8:
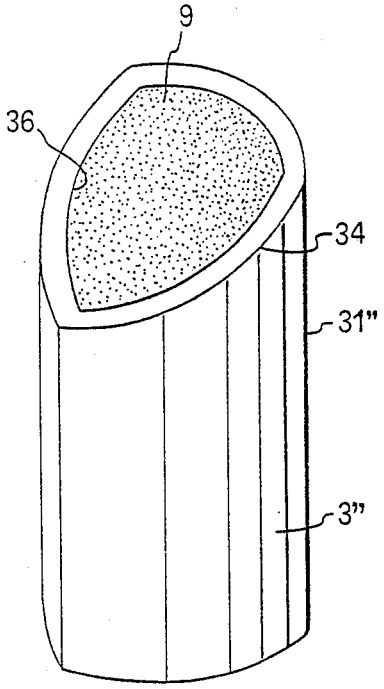
FIG. 8 is an isometric view of the upper part of the intermediate body, with stick inserted, having a transversal section in the form of a poligon.

When the means controlling the movement determine an axial shift only of the stick with respect to said upper portion of the intermediate body, said portion 3'' of the intermediate body can take the form of a tubular sleeve having a transversal section of whatever form. Likewise the cosmetic stick 9 can be of any transversal section, and not just the usual circular section. In particular said cosmetic stick can be of a transversal cross-section having three flat or curved sides (FIG. 8), or, not shown in the FIGS., having more than three sides, or having the form of an elipse. Also, the free upper extremity of the upper portion of the intermediate body 3, can have a form with an outline determined by a cross-section through a horizontal transversal plane, (upper extremity 34, FIGS. 2, 7), or through a plane inclined by 30° with respect to the horizontal plane transversal to the axis (upper extremity 34', FIGS. 1, 3, 4, 5, 8), or through a transversal plane of whatever inclination both of the upper portion of the intermediate body and of the cosmetic stick, preferably with a convex curved plane (FIG. 6) inclined by 30° with respect to the horizontal plane (upper extremity 34'').

As the case for stick cosmetics is formed by four fundamental parts, means are necessary to render axially integral but reciprocally rotating the intermediate body 3 and the external base body 2.

According to the invention these means are as hereinafter described.

One of said means is positioned on the long lower portion 3' of the intermediate body 3. Said lower portion has a transversal section substantially constant throughout the whole of its length, and it is provided on its outer cylindrical wall 31', just below the separation plane 32, with at least one slight annular projection 35 (FIGS. 1, 2, 4, 5, 6, 7). Alternatively two projections 35' slightly separated (FIG. 3) can be provided, having preferably a saw-toothed profile, to facilitate the insertion and at the same time prevent the extraction. The above described means coacts with another means 26, positioned on the surface of the inner cylindrical wall of the upper portion 2'' of the external base body 2, and/or of its covering 30 (FIGS. 4 and 5 right hand portions, and 7) near the upper extremity. Said means 26 consists of continuous or discontinuous depressed annular surfaces 26 embodied by means of an integral coupling of an additional annular element 30. Said element 30 can be a decorative metal band with its upper border 26'' turned inwards (FIGS. 4 and 5 right hand portions, and 7). The external base body 2 is a single piece, and it has to be made by means of forced stripping moulds, a technique which enables use only of less aesthetically attractive plastic materials. According to the invention, with the object of making use of less elastic, aesthetically more attractive materials, the following inprovements are provided. The wall of the external base body presents in the upper portion 2'' a reduced thickness 23 with respect to the lower portion 2'. This forms an annular abutment 22 on the outer wall, on which the free extremity 14 of cap 1 abuts. The wall is therefore more yielding, less rigid, in substance more elastic.

Figure 10:
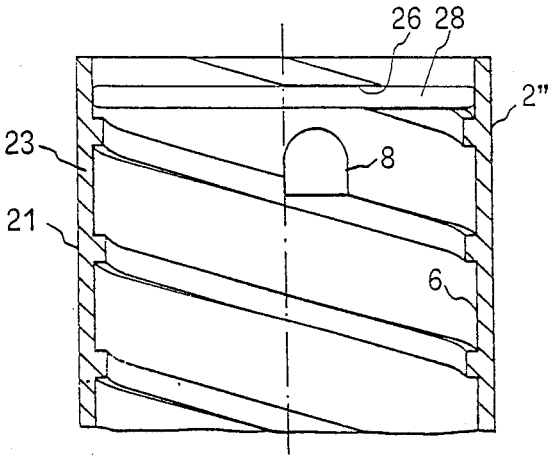
FIGS. 10 and 11 show in a longitudinal cross-section the inner wall of the external body and the relationship of a helicoidal groove crossing one circumferential depression (FIG. 10) and two depressions (FIG. 11) respectively.
Figure 11:
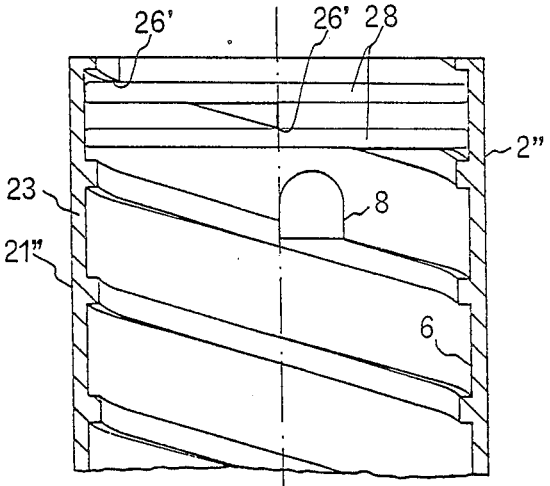

To improve the hold on the surface of the inner wall of the external base body 2 just below the upper extremity thereof, (FIG. 1 and others), a thread-like projection 27 having a preferably saw-toothed profile is made in the thickness 23, above a depression 28. Alternatively, (FIGS. 3, 11) double annular projections 27' are made slightly spaced, interrupted and crossed by at least one, 6' or 6'', or two, 6, helicoidal grooves (FIGS. 10, 11), such as to determined depressed surfaces 26 or respectively 26'. Said projections consist in slight reliefs abutting from the inner cylindrical wall towards the inside.

Figure 1:
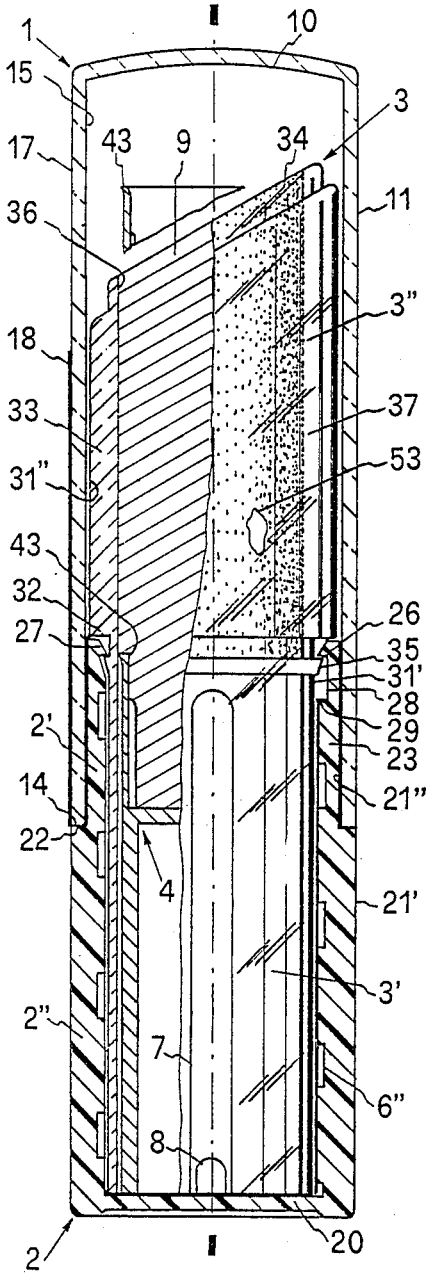
FIG. 1 is a front view, partly in cross-section and partly in view, of a case with a transparent intermediate body and a stick with an upper extremity inclined by 30° and with two forms of realization of the anchorage means of the intermediate body to the external base body.

To render still more elastic said upper portion 2'' of the external base body 2 the annular depression 28, placed on the surface of the inner wall, instead of having a form complementary to the profile of the sawtoothed projection 27 (FIGS. 1, 4, 5, 6 left hand portion), has, with respect to the latter, a much greater depressed profile. This creates an annular step 29 on the inside of the wall at a certain height underneath the annular projection 27 (FIGS. 1, 3, 6 right hand portions). This creates an elastic joint, having a reduced thickness 23 for the upper portion 2'', and facilitates the mould stripping operation.

In order to avoid a forced mould stripping and use materials with a better external aesthetic aspect, an additional element 30 may be attached to cover the upper portion of the external base body 2. Said element 30 maay be a metal band or a tubular sleeve with its upper end 26'' turned inwards (FIGS. 4 and 5 right hand portions, and 7). Between said end 26'' and the upper portion of the external base body 2, an annular depression 28 is formed, as one of the snap-on means for rendering the intermediate body 3 and the external base body 2 axially integral and mutually rotating.

As has been described, it may be desirable to form the stick directly inside the case of the present invention. To this end a capsule 5 adheres with elastic pressure to the whole perimeter of the edge on its upper extremity 34. Said elastic pressure is such as to determine on said upper extremity 34 a sealed closure. The upper extremity 43 of the stick holder 4 adheres with elastic pressure along its entire perimeter to the inner wall 36 of the intermediate body 3. Said upper extremity 43 is positioned at a height superior to the axial slot 7 or to the helicoidal slot 7'. This determines a hermetic seal between said stick holder 4 and the inner wall 36 of the upper portion of said intermediate body 3, so that said case contains internally a hollow, closed recipient forming the shape of a mould for the stick 9.

According to the invention the closing capsule 5, having on one side the support 51 of the cap 1, adheres on the other side with elastic pressure to the upper portion of the intermediate body 3, preferably in correspondance with the upper extremity 34. Said capsule has a peripheral outline corresponding to the peripheral outline of the intermediate body 3 and a transversal section of whatever kind. Said transversal section can be, apart from circular, poligonal with three or more flat or curved sides, or of an oval or eliptical shape. The surface which forms the end part of the stick can be made not only with a transversal surface horizontal with respect to the axis, but also with a flat surface 50 (FIG. 5) or a curved surface 50' (FIG. 6) inclined with respect to the transversal plane horizontal to the axis.

With the object of permitting the moulding of the stick inside the case, a stick holder 4 can be in the shape of a tubular sleeve. Said tubular sleeve has open extremities 43 and 44, and is of a height approximately equal to that of the inner wall of the external base body 2. Said stick holder 4 has an open transversal integral partition 41 at a certain height as a bearing for the base of stick 9. Said partition 41 divides holder 4 into two portions, upper 4'', for anchorage of the base of the stick, and lower 4'. Therefore, the invention provides the following alternative operations.

The melted product 9' is poured in from the base of the case, said melted product being inserted at the lower extremity of the lower portion 44 of the stick holder 4 (FIG. 3), when the external base body 2 is disconnected and the case is upside down in the filing position. In this way the fluid cosmetic mass 9' can pass through and cover opening 42 on the bearing partition 41 of the base of stick 9 and completely fill the closed hollow upper recipient forming the mould for the stick.

Alternatively, the melted product 9' is poured in from the top of the case, when the cap and the closing capsule 5 are disconnected, and the stick holder 4 is in a completely retracted position within the case (FIG. 4). The portion of lower extremity 44, rendered elastic by reduction of the thickness 46, can be in engagement with an internal annular projection 24, (FIG. 4) on the bottom 20 of the external base body 2. This forms a hermetic seall between the two bodies 44 and 24 so that the fluid cosmetic mass 9', when it is poured from the upper extremity 34 up to a certain level into the intermediate body 3, can pass beyond opening 42 on the bearing partition 41 and fill the hollow closed recipient 45, formed in the lower portion 4' of the stick holder 4. Said hollow closed recipient serves to momentarily gather the product.

After successively inserting the above mentioned closing capsule 5 and the cap 1 (FIG. 5), the case is turned upside down. In this way the cosmetic mass 9', which is still fluid, falls from the lower portion 4' of the holder 4, through the opening 42 on the bearing partition 41, into the upper hollow closed recipient forming the mould for the stick. In both cases said upper recipient is formed by the flat (50) or curved (51) wall of the closing capsule 5, by the inner wall 36 of the intermediate body 3, and by the wall of the stick holder 4.

In an alternative embodiment, (FIGS. 6 and 7), the stick holder 4 has the form of a tubular sleeve, with an open upper extremity 43 and with the other extremity completely closed by an end wall 40 and 40'. Said holder is of a height almost equal to the height of the inner wall of the external base body 2 and has a transversal integral bearing partition 41 at a certain height. Said bearig partition serves to bear the stick, and divides the holder into two portions lower 4' and upper 4''. The transversal bearing partition 41 is obtained internally in the thickness of the tubular wall, not illustrated in the drawings, in such a way that the upper portion 4'' has a transversal surface greater than the lower portion 4'. In this way a perimetral abutment is determined for bearing the base of the stick.

In another embodiment (FIG. 6) the transversal bearing partition is obtained from the top wall 41' of an axial sleeve 47 of whatever transversal section (FIG. 6). Said sleeve is of smaller dimensions with respect to the transversal section of the sleeve of the holder 4. The opposite open extremity 48 of the sleeve integrally closes the annular base wall 40' of the holder, where said annular base wall 40' has a surface complementary to the open transversal surface 48 of the sleeve.

In a further embodiment (FIG. 7) the transversal bearing partition can be obtained fro a rim 41'' or from a crown of transversal tongues projecting outwards. Said crown is integral with the open upper extremity of an axial tubular sleeve 47 of whatever transversal section, having at least one longitudinal slot 49. The opposite open lower extremity of said sleeve 47 is integral with the closed wall of the base wall 40 of the holder 4.

According to the examples described the portion of holder 4' sitatuted below the bearing partition 41, 41', 41" can act as a closed hollow recipient 45 for the momentary gathering of the fluid cosmetic product 9', when said cosmetic mass 9' is inserted at the open extremity of the case 34, 34', 34", with cap 1 and closing capsule 5 or 5' disconnected (FIG. 6, left hand portion).

Successively, after having inserted the closing capsule 5 on the upper portion 3" of the intermediate body (FIG. 6, right hand portion) or alternatively the closing capsule 5' on the upper extremity of the stick holder 43 (FIG. 7), the case is turned upside down so that the still fluid cosmetic mass 9' can fall from the lower portion of the holder 4 through the opening 42 into the upper hollow closed recipient forming the mould of the stick 9.

In the above cases said upper recipient which forms the mould of the stick is formed by the inner surface 50" of the closing capsule 5' in one embodiment (FIG. 7), or by the flat (50) or curved (50') surface of the closing capsule 5 and by the inner wall of the intermediate body 3 in another embodiment (FIG. 6), and in both embodiments by the inner wall of the stick holder 4 and the bearing partition 41' or 41" of the stick.

For forming the stick 9 inside the case and in a position completely external thereto the stick holder 4 is at least as long as the stick 9, protruding from it, with the upper extremity 43 and the lower extremity closed by a bottom surface 40', 40. Alternatively the lower extremity can be temporarily closed by a hermetic seal between said lower extremity 44 and annular surfaces 24 integral with the bottom of the inner wall 20. An open transversal partition 41, 41', 41" is a bearing for the stick. The partition can be annular (41) obtained internally in the thickness of the tubular sleeve, or annular (41") or flat (41') supported by tubular sleeves 47, open or closed, integral with the closed bottom surface 40. The upper portion 4" of said stick holder 4 has the function of retaining the base of the stick, while the lower portion 4' has the function of a momentary gathering recipient 45 for the product 9'. When the holder 4 is completely extended, so that its upper extremity 43 is slightly protruding with respect to the upper extremity 34, 34', 34" of the case, or alternatively of the intermediate body, it is completely filled with the melted cosmetic product 9'. Successively, after having hermetically applied to said upper extremity 43 of the holder 4 a hollow recipient or a closing capsule 5', having the function of a mould for the stick, the case is turned upside down so that the melted cosmetic product 9', still in a fluid state, can perculate from the bottom of the stick holder, into the recipient. The fluid cosmetic product 9' hardens into the form of stick 9, said stick being anchored by its base both in the open transversal bearing partition 41, 41', 41" and in its upper portion 4" and protruding from the edge 43 of said stick holder. When the stick has been formed, with a capsule 5' made of transparent material, it is possible to see from the outside the quality of the stick moulded or eventual malformations 53.

Successively, after inspection of quality, the holder 4 is returned inside the case, carrying the stick 9 into its retracted position, removed from its mould.

At this point the capsule 5' can be removed and the cap 1 for closing the case can be inserted.

For anchoring the bottom of the stick, undercut surfaces 54 can be provided, in the case that, in the pouring operation and successive solidification, the product remains at a level 52 partly below the bearing partition of the stick.

Means are also provided to set an end of the stroke of the stick holder 4 (FIGS. 4, 5). To this end the wall corresponding to the lower extremity 44 of the holder 4 is made elastic by reduction of the thickness 46, and when in a completely retracted position, it is in an elastic friction engagement with an internal annular surface 24. Said surface 24 can be projected or depressed, and is positioned on the bottom 20 of the external base body 2, so as to determined a frictional fit between the two bodies, around about the position of the end of the stroke.

Means are also provided for determining the movement of extension and retraction of the stick holder in which the outer wall of said stick holder 4 is provided with at least one rigid pin 8 and with at least one elastic pin 8' (FIG. 9). The rigid pin 8 is positioned on a portion of rigid wall, so as not to substantially reduce, even following a certain pressure, its distance with respect to the axis, whereas the elastic pin 8' is positioned on a portion of elastic wall, so as to noticeably reduce, following a certain pressure, its distance with respect to the axis. Both pins 8 and 8' are slidable, along at least one guide slot 7, 7' on the intermediate body 3, in the groove 6' or 6" or in the respective grooves 6. In an alternative solution not illustrated in the figures, the elastic pin 8' is slidable along at least one guide slot 7, 7' of the intermediate body 3, on the inner wall of the external base body 2, the rigid pin 8 not being in contact with the bottom of said groove 6, 6', 6", the elastic pin 8', on the other hand, being in contact with elastic friction with said bottom of groove 6, 6', 6".

This device gives the advantage of a frictionally sliding movement of the holder 4. The elastic pin 8' cannot leave the groove 6, 6', 6" at the upper and lower ends of the stroke, due tothe fact that the respective rigid pin 8 is always inserted in its guide groove. This means that the external base body is not permitted to rotate idly with respct to said holder 4 on the upper and lower positions of the end of the stroke.

In a further embodiment of the operative movement of the stick holder, the pin 8 on the outer wall of said stick holder 4 slides along a helicoidal slot 7', made in the wall of the lower portion 3' of the intermediate body 3, and in a helicoidal groove 6', 6", made in the cylindrical inner wall of the external base body 2 (FIG. 7). If the pitch of the groove 6' is less than one turn, as is generally used to save cost in the moulding operation, the coupling of said helicoidal groove 6' with an helicoidal slot 7' of opposite hand permits the pin 8 of the stick holder 4 to move with a movement equal to the sum of the respective pitches, of slot 7' and groove 6', determining a slower extraction movement than that of the helicoidal groove 6' alone.

Furthermore, the pin 8, on which the pressure of the stick is transmitted through the stick holder, is maintained in a vertical position by the crossing of slot 7' and groove 6', instead of the crossing of the helicoidal guide 6' of the external base body 2 with the axial guide 7 of the intermediate body 3.

Furthermore, according to an additional improvement, between the inner top wall 10 of the cap 1 when closed (FIG. 2) and the tip of stick9 an axial distance A is provided such as to determine a safety margin. In this way stick 9 cannot become deformed by impact on said top wall 10 of the cap by involountary axial movements.

According to an additional improvement, cap 1 can be made in opaque material and provided with at least one opening, (FIG. 3), such as a hole 19 of whatever geometrical or ornamental form. Furthermore, said cap can also be made of transparent material rendered opaque, masked by a covering 18, which can be a metal band, a rolled tape (FIG. 1), a galvanized layer, a serigraphy or the like. This makes it possible to have transparent openings in said covering, which can be holes 19 of whatever geometrical or ornamental shape or annular band sections 17 of whatever form and in whatever position.

For the inspection of the quality of the bottom surface of the stick, the external base body 2 can be made of transparent material. Through the guide slot 7 or 7' of the intermediate body 3 the portion of wall of the stick holder 4 can be seen. If the latter is transparent, the portion of the bottom surface of stick 9 can also be seen. If the intermediate body 3 is also transparent, all the portion of the bottom of stick 9 can be seen directly from the outside of the case.

What is claimed is:

1. In a case for stick cosmetics of the type having:

(a) a cap in the form of a tubular sleeve with an open lower extremity, (b) an external base in the form of a tubular sleeve with an open upper extremity, a closed bottom and an internal helicoidal groove, (c) an intermediate body in the form of a tubular sleeve with both extremities open and a lower portion having a pair of opposed longitudinal slots and an upper portion having an increased wall thickness so as to form an outer annular periferal step, said lower portion of the intermediate body being telescopically engaged with said external base, and (d) a stick holder in the form of a tubular sleeve with open extremities and an inner partition for supporting the stick and a pair of opposed outwardly projecting pins at the lower extremity, said pins being engaged with both said grooves and said slots for a translatory movement of said stick holder along said intermediate body from a retracted to an extended position upon rotation of said external base with respect to said intermediate body, said external base and said cap having the same outer diameter, the improvement which comprises said external base formed of one piece made of essentially rigid moulded plastic material and having an upper portion of reduced wall thickness with both a reduced outer diameter and an increased inner diameter with respect to the lower portion of said base and an outer annular step for abutment with said cap, said upper portion of the base abutting on said outer annular step of said intermediate body and having at least one inner annular projection, and said intermediate body having on its outer wall at least one annular projection for a snap engagement with said projection of the base.

2. The stick case of claim 1, wherein said partition in the stick holder is provided with a central opening.

3. The stick case of claim 1, wherein said projection in the base and said projection in the intermediate body have a saw-tooth shape on a longitudinal cross-section.

4. The stick case of claim 1, further comprising a lower portion of said cap with an enlarged inner diameter, and a sealing sleeve of soft material is attached to the inner surface of said lower portion of the cap for a tight sealing closure between said cap and said base.

5. The stick case of claim 1, wherein said base has, integral with said bottom thereof, an inner circular raised portion adapted to be sealingly engaged with the lower extremity of said stick holder, and said partition of the stick holder has an opening whereby the moulding of the stick can be made directly in the case, by pouring a fluid stick material into the top of the intermediate body.

6. A method for forming a stick in a stick case as defined in claims 5 comprising: pouring an amount of fluid stick material adequate for forming a stick into the upper open extemity of the intermediate body with said stick holder in the retracted position and said base mounted on the intermediate body; securing a moulding closure capsule on the upper extremity of said intermediate body; turning upside down the assembly consisting of base, intermediate body and capsule for bringing the fluid material into contact with said capsule; and cooling and solidifying said material to a solid stick.

7. A method for forming a stick in an assembled stick case as defined in claim 5, comprising:

pouring an amount of fluid stick material adequate for forming a stick into the upper open end of the stick holder, with said stick holder in its position of maximum extraction and its upper end slightly protruding from the upper extremity of the case; securing a moulding closure capsule on said upper extremity of said stick holder for forming a mould, turning upside down the assembly consisting of base, intermediate body and capsule for bringing the fluid material into contact with said capsule; cooling and solidifying said material to a solid stock; and retracting the stick holder for detaching the stick from the mould.

8. The stick case of claim 1, wherein one or more of said cap, intermediate body, stick holder or external base is partially or completely transparent for showing the colour of the stick.

9. In a case for stick cosmetics of the type having:

(a) a cap in the form of a tubular sleeve with an open lower extremity, (b) an external base in the form of a tubular sleeve with an open upper extremity, a closed bottom and an internal helicoidal groove, (c) an intermediate body in the form of a tubular sleeve with both extremities open and a lower portion having a pair of opposed longitudinal slots and an upper portion having an increased wall thickness so as to form an outer annular peripheral step, said lower portion of the intermediate body being telescopically engaged with said external base, and (d) a stick holder in the form of a tubular sleeve with open extremities and an inner partition for supporting the stick and a pair of opposed outwardly projecting pins at the lower extremity, said pins being engaged with both said grooves and said slots for a translatory movement of said stick holder along said intermediate body from a retracted to an extended position upon rotation of said external bse with respect to said intermediate body, said external base and said cap having the same outer diameter, the improvmeent which comprises said external base formed of one piece and having an upper portion of reduced wall thickness with an outer annular step for abutment with said cap, said upper portion of the base having at least one inner annular projection, and said intermediate body having on its outer wall at least one annular projection for a snap engagement with said projection of the base wherein said stick holder has an opening in the partition, a closed bottom, and an internal column member which is integral with said bottom, whereby the moulding of the stick can be made directly in the case by pouring a fluid stick materail into the top of the intermediate body.

10. A method for forming a stick in a stick case as defined in claim 9 comprising:

pouring an amount of fluid stick material adequate for forming a stick into the upper open extremity of the intermediate body with said stick holder in the retracted position and said base mounted on the intermediate body; securing a moulding closure capsule on the upper extremity of said intermediate body; turning upside down the assembly consisting of base, intermediate body and capsule for bringing the fluid material into contact with said capsule; and cooling and solidifying said material to a solid stick.

11. A method for forming a stick in an assembled stick case as defined in claim 9, comprising:

pouring an amount of fluid stick material adequate for forming a stick into the upper open end of the stick holder, with said stick holder in its position of maximum extraction and its upper end slightly protruding from the upper extremity of the case; securing a moulding closure capsule on said upper extremity of said stick holder for forming a mould, turning upside down the assembly consisting of base, intermediate body and capsule for bringing the fluid material into contact with said capsule; cooling and solidifying said material to a solid stock; and retracting the stick holder for detaching the stick from the mould.

12. In a case for stick cosmetics of the type having:

(a) a cap in the form of a tubular sleeve with an open lower extremity, (b) an external base in the form of a tubular sleeve with a open upper extremity, a closed bottom and an internal helicoidal groove, (c) an intermediate body in the form of a tubular sleeve with both extremities open and a lower portion having a pair of opposed longitudinal slots and an upper portion having an increased wall thickness so as to form an outer annular peripheral step, said lower portion of the intermediate body being telescopically engaged with said external base, and (d) a stick holder in the fo rm of a tubular sleeve with open extremities and an inner partition for supporting the stick and a pair of opposed outwardly projecting pins at the lower extremity, said pins being engaged with both said grooves and said slots for a translatory movement of said stick holder along said intermediate body from a retracted to an extended position upon rotation of said external base with respect to said intermediate body, said external base and said cap having the same outer diameter, the improvement which comprises said external base formed of one piece and having an upper portion of reduced wall thickness with an outer annular step for abutment with said cap, said upper portion of the base having at least one inner annular projection, and said intermediate body having on its outer wall at least one annular projection for a snap engagement with said projection of the base, wherein one of said pins in the stick holder is in rigid friction contact with the inner wall of said base and the other pin is in elastic friction contact with said wall.

* * * * *